US005345795A

United States Patent [19]

James et al.

[11] Patent Number: 5,345,795

[45] Date of Patent: Sep. 13, 1994

[54] LOCK STRUCTURE

[75] Inventors: Brent A. James; Garrick D. James, both of Williamsville, N.Y.

[73] Assignee: Diversified Control, Inc., Orchard Park, N.Y.

[21] Appl. No.: 848,865

[22] Filed: Mar. 10, 1992

[51] Int. Cl.[5] ..... B65D 55/14; E05B 65/44

[52] U.S. Cl. ..... 70/84; 70/136; 70/160; 70/162; 70/DIG. 13; 292/240

[58] Field of Search ..... 70/69-81, 70/84, 136, 137, 140, 159, 160, 162, 423, 455, DIG. 13, DIG. 34, DIG. 57, DIG. 72; 292/212, 240-242, DIG. 10, DIG. 11, DIG. 34

[56] References Cited

U.S. PATENT DOCUMENTS

| | | | |
|---|---|---|---|
| 1,224,534 | 5/1917 | Hall | 70/DIG. 13 X |
| 2,399,812 | 5/1946 | Ledin | 70/84 |
| 2,803,956 | 8/1957 | Womer | 70/84 X |
| 3,391,256 | 7/1968 | Nawman | 70/DIG. 72 X |
| 3,392,556 | 7/1968 | Atkinson | 70/71 |
| 3,964,280 | 6/1976 | Kelton | 70/84 |
| 4,195,867 | 4/1980 | Baillie | 70/81 X |
| 4,339,629 | 7/1982 | Stanmore | 70/DIG. 57 X |
| 4,674,306 | 6/1987 | Halpern | 70/DIG. 57 X |
| 4,813,253 | 3/1989 | Dumas | 70/84 X |
| 5,060,993 | 10/1991 | Maier | 292/240 X |

FOREIGN PATENT DOCUMENTS

| | | | |
|---|---|---|---|
| 1271223 | 4/1972 | United Kingdom | 70/DIG. 57 |

*Primary Examiner*—Peter M. Cuomo
*Assistant Examiner*—Suzanne L. Dino
*Attorney, Agent, or Firm*—Joseph P. Gastel

[57] ABSTRACT

A lock structure for mounting between first and second supporting surfaces including a cup mounted on the first surface, a housing mounted on the cup, a rocker arm located within the housing and pivotally mounted on the cup, a keeper mounted on the second supporting surface, interengaging surfaces between the rocker arm and the keeper for effecting a locking relationship therebetween, a spring located between the housing and the rocker arm to bias the rocker arm in a locking position relative to the keeper, and an actuator shaft keyed to the rocker arm and rotatably mounted in the housing and having a curvilinear groove therein for receiving a mating key for pivoting the actuator shaft and the rocker arm keyed thereto out of locking engagement with the keeper.

27 Claims, 3 Drawing Sheets

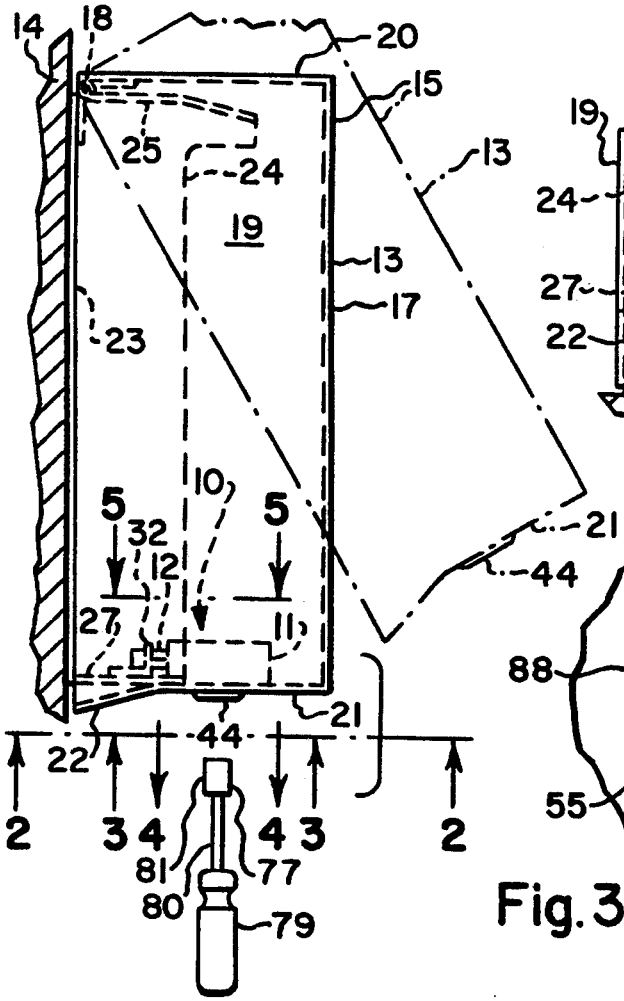
Fig. 1.
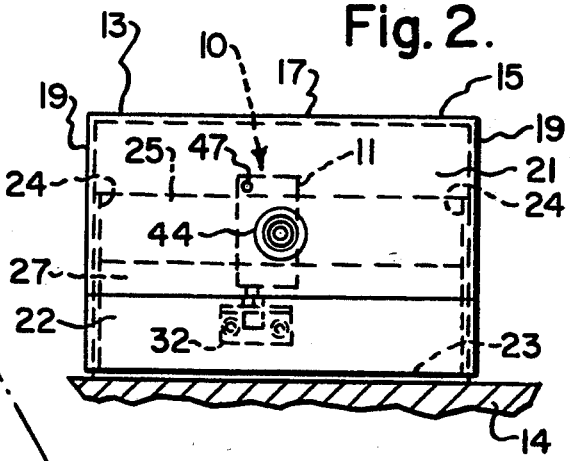
Fig. 2.
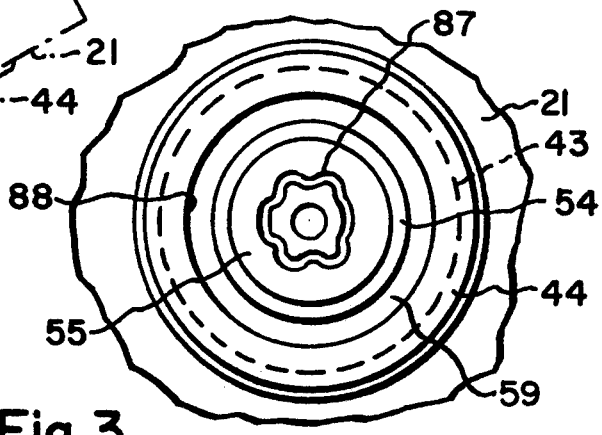
Fig. 3.
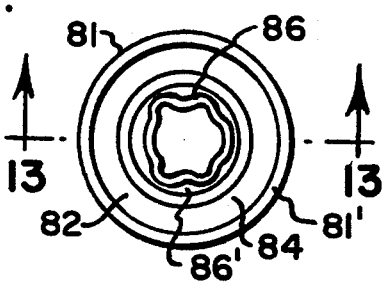
Fig. 4.
Fig. 5.
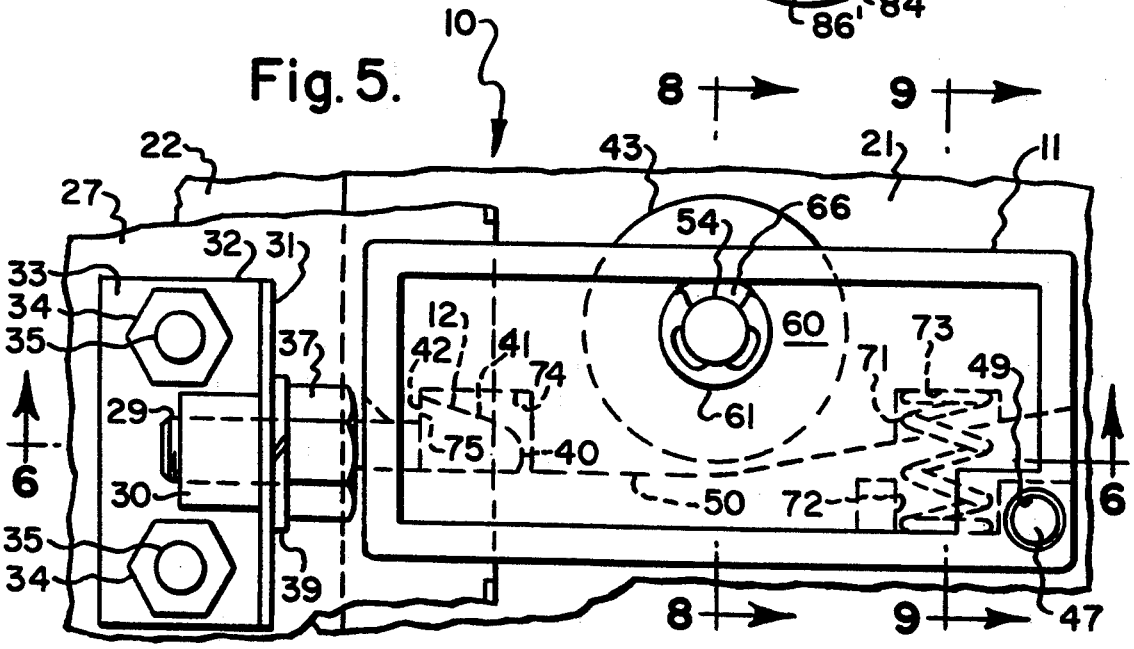

Fig. 6.
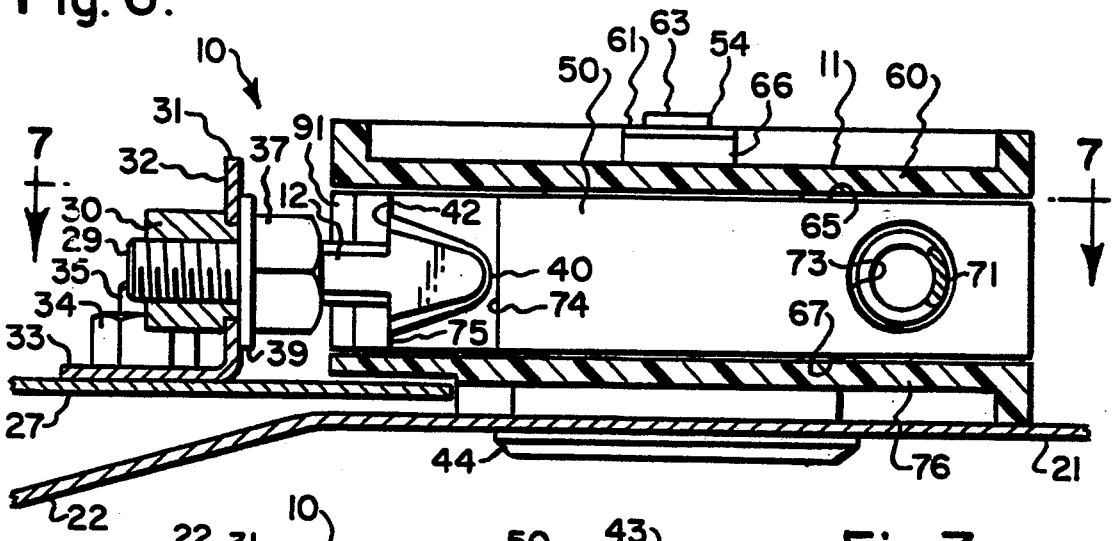
Fig. 7.
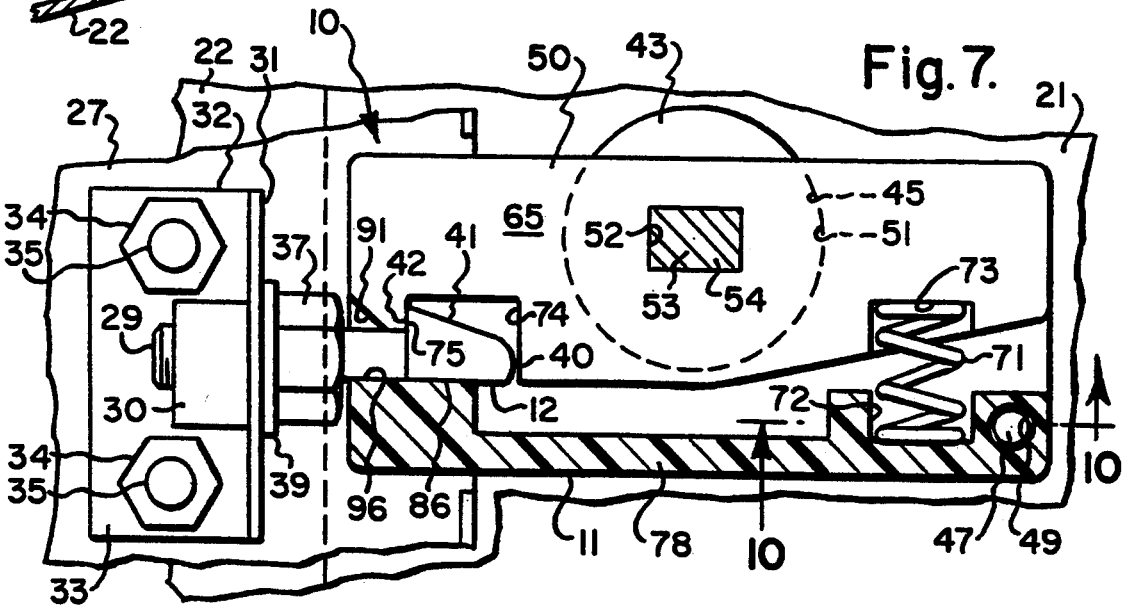
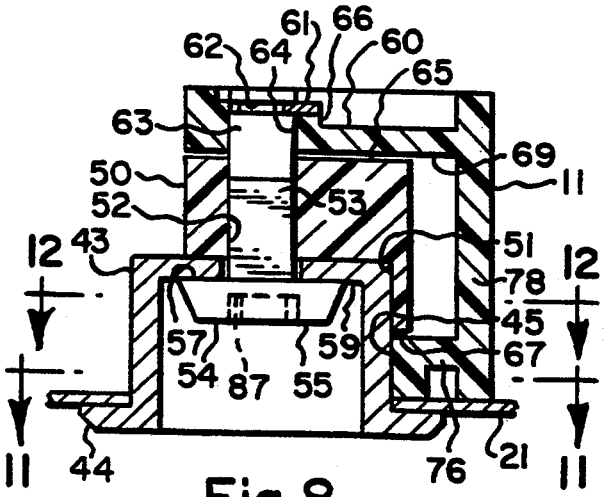
Fig. 8.
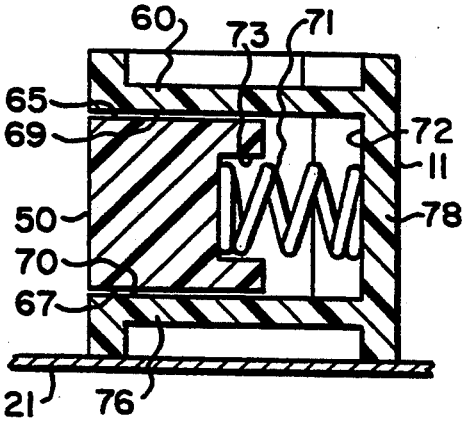
Fig. 9.

LOCK STRUCTURE

BACKGROUND OF THE INVENTION

The present invention relates to a lock structure of the type which is used to lock a cabinet door.

In the past the covers of certain types of cabinets were locked by the use of a key-actuated pattern-headed screw-threaded bolt which passed through a movable cover and a stationary wall of the cabinet. However, this required an actual manual turning of the bolt, and if it was not tightened sufficiently, it could be loosened without the use of a key.

SUMMARY OF THE INVENTION

It is one object of the present invention to provide a lock which is unlocked by the use of a key which turns a pattern-headed bolt for a fraction of a turn and which will cause the cover of a cabinet to lock automatically on closing without requiring key actuation of the bolt.

It is another object of the present invention to provide a lock structure which essentially comprises one movable part mounted in a housing and thus is of relatively simple construction.

A further object of the present invention is to provide an improved lock structure as described in the preceding paragraph which cooperates with a stationary keeper to effect a locked condition.

Yet another object of the present invention is to provide a lock structure wherein the parts are mounted in a unique manner on a cup which contains a recessed portion of the key actuatable pattern-headed bolt.

A still further object of the present invention is to provide a lock structure in which the pattern-headed bolt can be changed in a simple and expedient manner to thereby change the pattern of a key which is required to turn it. Other objects and attendant advantages of the present invention will readily be perceived hereafter.

The present invention relates to a lock structure for mounting on a supporting surface comprising a housing, means mounting said housing on said supporting surface, a rocker arm, means pivotally mounting said rocker arm on said housing, an actuator bolt, means coupling said actuator bolt relative to said rocker arm to effect pivotal movement thereof, and a patterned head on said actuator bolt for receiving a mating patterned key.

The various aspects of the present invention will be more fully understood when the following portions of the specification are read in conjunction with the accompanying drawings wherein:

BRIEF DESCRIPTION OF THE DRAWINGS

FIG. 1 is a fragmentary exploded side elevational view of the improved lock structure mounted on a cabinet and the key for operating the lock;

FIG. 2 is a bottom plan view of the cabinet taken substantially in the direction of arrows 2—2 of FIG. 1 and showing the key hole mounted on the bottom wall of the cabinet;

FIG. 3 is a fragmentary enlarged view taken substantially in the direction of arrows 3—3 of FIG. 1 and showing the key hole structure;

FIG. 4 is an enlarged view taken substantially in the direction of arrows 4—4 of FIG. 1 and showing the end of the key;

FIG. 5 is a fragmentary enlarged view taken substantially in the direction of arrows 5—5 of FIG. 1 and showing the lock structure in a locked condition;

FIG. 6 is a fragmentary cross sectional view taken substantially along line 6—6 of FIG. 5;

FIG. 7 is a fragmentary cross sectional view taken substantially along line 7—7 of FIG. 6;

FIG. 8 is a fragmentary cross sectional view taken substantially along line 8—8 of FIG. 5;

FIG. 9 is a fragmentary cross sectional view taken substantially along line 9—9 of FIG. 5;

DESCRIPTION OF THE PREFERRED EMBODIMENTS

Figure 14:
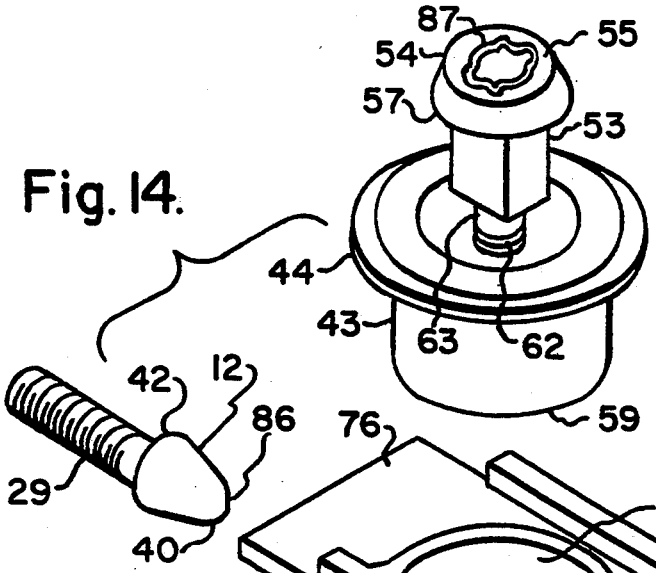
FIG. 14 is a fragmentary exploded view of the lock structure.

The improved lock structure 10 is shown in FIG. 1 as mounted on a cabinet 13 which is mounted on vertical wall 14. The cabinet 13 includes a movable cover 15 which is substantially of solid rectangular form, and it includes a front wall 17, two side walls 19, a top wall 20 and a bottom wall 21 which includes a flared end portion 22. The cabinet includes a rear wall 23 which is suitably fastened to wall 14, a pair of like side walls 24 secured to the rear wall, a top wall 25 connecting the side walls and a bottom wall 27 also connecting the side walls. Lock housing 11 is mounted on the bottom wall 21 of the cover, and the plunger or keeper 12 is mounted on the bottom wall 27 of the cabinet.

The plunger or keeper 12 includes a screw threaded shank 29 which is threadably received in sleeve 30 which is press-fitted into leg 31 of angle bracket 32. The other leg 33 of the angle bracket 32 is fastened to bottom wall 27 by nuts 34 which thread onto bolts 35 which are welded to wall 27. The keeper shank 29 is locked in position by a nut 37 which threads onto shank 29 and bears on lock washer 39, both of which are on the opposite side of angle leg 31 from sleeve 30. The shank 29 terminates at a head 40 which includes a curved surface 41 which terminates at a planar surface 42 (FIG. 7).

Figure 10:
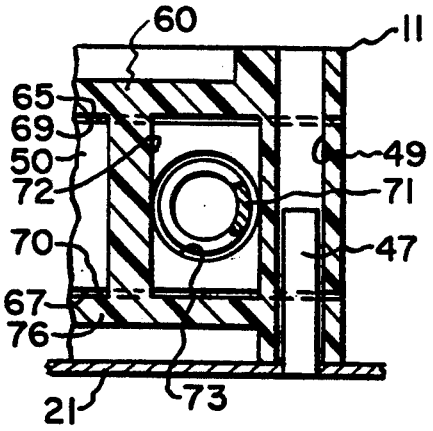
FIG. 10 is a fragmentary cross sectional view taken substantially along line 10—10 of FIG. 7.
Figure 11:
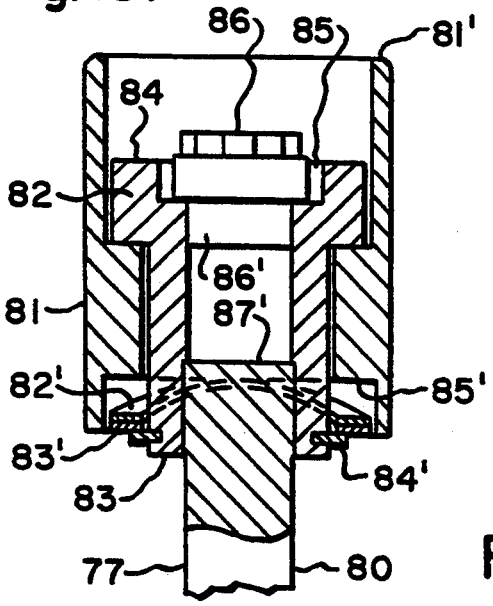
FIG. 11 is a fragmentary cross sectional view taken substantially along line 11—11 of FIG. 8 and showing the manner in which the lock housing fits onto the sleeve which houses the actuator bolt.
Figure 11:
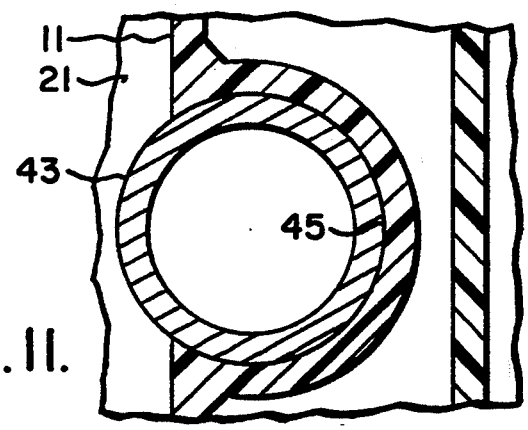

The head 40 of keeper 12 is received in housing 11 when cover 15 is in a locked position. More specifically, housing 11, which is molded plastic, is mounted on wall 21 of cover 15. In this respect, a cylindrical metal sleeve or cup 43 includes a circular lip 44 which is welded to the outside of wall 21. Housing 11 includes an arcuate cutout 45 (FIGS. 11 and 14) which fits on to sleeve 43. A pin 47 (FIGS. 5 and 10) has one end rigidly affixed to wall 21, and it extends inwardly into a bore 49 in housing 11. The connection between housing 11, sleeve 43 and pin 47 anchors housing 11 against rotational sliding on sleeve 43.

Figure 12:
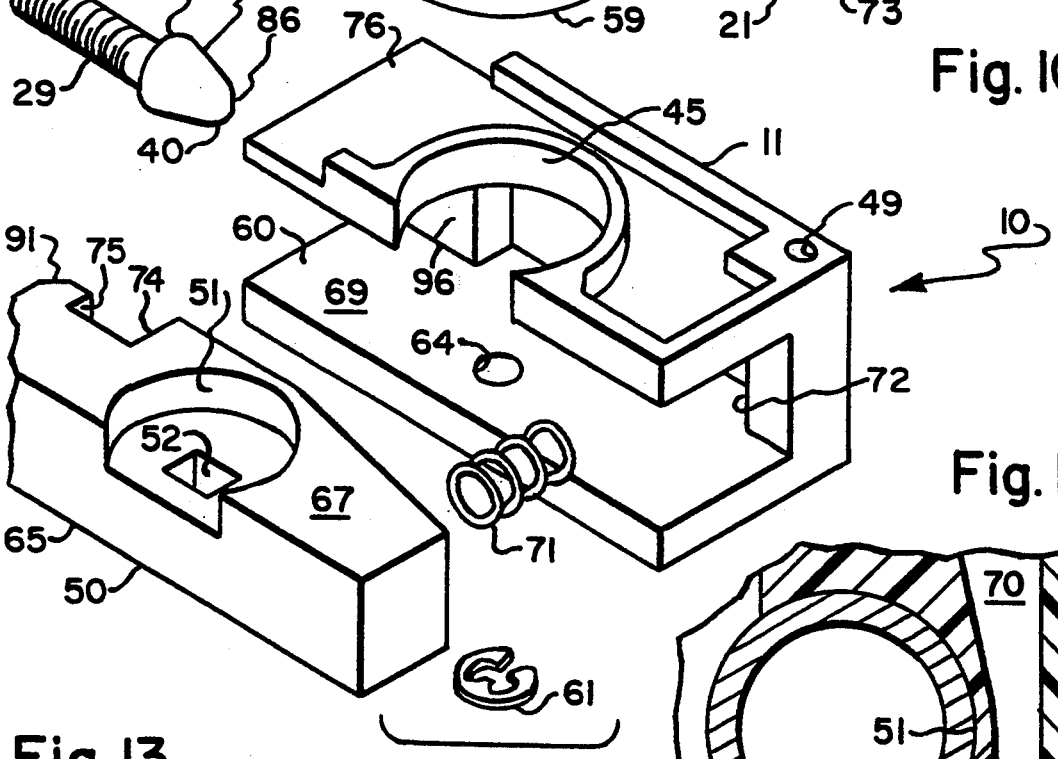
FIG. 12 is a fragmentary cross sectional view taken substantially along line 12—12 of FIG. 8 and showing how the rocker arm is rotatably mounted on the sleeve.

A rocker arm or latch 50, which is molded plastic, is pivotally mounted on sleeve or cup 43. In this respect, rocker arm 50 has an arcuate surface 51 (FIGS. 12 and 14) which fits on to a portion of the circumference of sleeve 43. Also, rocker arm 50 includes a rectangular bore 52 (FIGS. 7 and 14) which receives a rectangular portion 53 of actuator bolt 54 (FIG. 8). The key-receiving end or head 55 of actuator bolt 54 is located within cup 43 and it has a surface 57 (FIG. 8) which bears on the plate-like or flange end 59 of cup 43. The key-receiving end 55 of the actuator bolt has a key-receiving pattern in the form of a key-receiving groove 87 therein, and it is protected against excessive exposure to the elements because of its location within cup 43. Also, the key-receiving end 55 is not accessible to tools, so that it cannot be rotated except by a proper key. Also the key-receiving end 55 has a frustoconical outer surface which cannot be grasped by a tool, even if it could satisfactorily enter sleeve 43.

The opposite end of actuator bolt 54 extends through wall 60 and boss 66 of housing 11. The end portion 63 of actuator bolt 54 is cylindrical and fits into cylindrical bore 64 in housing wall 60. A retaining clip 61 snaps into groove 62 of the actuator bolt to lock it in position. As can be seen from FIG. 8, surface 57 of bolt 54 bears on plate 59 and clip 61 bears on boss 66 of housing 11, and this locks housing 11 against movement in a direction axially of bolt 54. If it is desired to change the pattern of the key-receiving groove 87, it is merely necessary to remove actuator bolt 54 and replace it with another one having a different groove pattern therein.

The opposite sides 65 and 67 (FIG. 9) of rocker arm 53 are slidably retained within housing wall surfaces 69 and 70, respectively, of housing walls 60 and 76, respectively, which are connected to each other by end wall 78. A spring 71 (FIG. 9) is captured between depression 72 in housing 11 and cylindrical depression 73 in rocker arm 50 to bias rocker arm 50 in a counterclockwise direction in FIGS. 5 and 7 about the common axis of sleeve 43 and actuator bolt 54. The end of rocker arm 50 remote from spring 71 includes a rectangular cutout 74 (FIGS. 6 and 7) which receives head 40 of plunger 12 in a locking position. In this respect, planar surface 42 of plunger head 40 engages lip 75 of cutout 74 (FIG. 7) when the lock is in a locking position. In the locked condition, the flat surface 86 of plunger 12 is located in contiguous relationship to planar surface 96 of housing wall 78, and rocker arm 50 is biased to the position of FIGS. 7 and 5 by spring 71. The strength of spring 71 can be selected to provide the desired biasing force.

Figure 13:
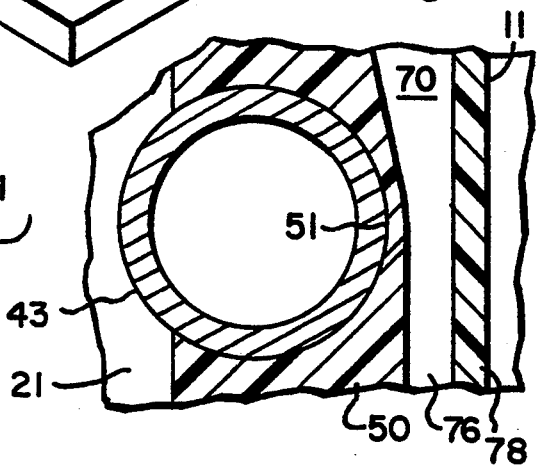
FIG. 13 is a cross sectional view of the key taken substantially along line 13—13 of FIG. 4.

The lock is unlocked by the use of a key 77 (FIGS. 1 and 13) which in this instance is similar to a socket wrench having a handle 79 and a shank 80 and a key socket 81. Located within socket 81 is a sleeve 82 which has its end 83 press-fitted on the end 87' of shank 80. An annular shoulder 84 is located at the end of sleeve 82. Positioned concentrically within shoulder 84 and spaced therefrom by gap 85 is a member 86' which is press-fitted into sleeve 82. Member 82 has a curvilinear ridge 86 thereon (FIGS. 4 and 13) which is of the same pattern as curvilinear groove 87 (FIGS. 3 and 8) which is located in head 55 of actuator bolt 54. The diameter of sleeve 81 is less than the internal diameter 88 of sleeve or cup 43.

When it is desired to unlock lock structure 10, sleeve 82 of key 77 is inserted into sleeve 43 until its annular end 81' engages the surface of plate-like end 59 (FIG. 8) of cup 43. Sleeve 81 will then move toward shank 80 against the bias of Bellville washer 82' which is located between washer 83', retained on shank 80 by snap ring 84', and annular shoulder 85' in sleeve 81. The key 77 is then rotated until the patterned curvilinear ridge 85, seats itself into mating patterned curvilinear groove 87, whereupon actuator bolt can be rotated in a clockwise direction in FIGS. 5 and 7 to thus pivot rocker arm 50 in a clockwise direction against the bias of spring 71 to thus disengage surfaces 42 and 75 to effect an unlatching or unlocking of the lock. Cover 13 can be swung in a counterclockwise position from its solid line position in FIG. 1 about the axis of hinge 18. The foregoing swinging motion can be effected while sleeve 81 of key 77 is in sleeve 43, and thus key 77 also acts as a handle.

When it is desired to bring cover 13 back to its locked solid line position, it is merely necessary to swing it in a clockwise direction in FIG. 1 whereupon inclined camming surface 91 (FIG. 7) of the rocker arm will ride over inclined surface 41 of plunger head 40, and rocker arm 50 will pivot in a clockwise direction in FIG. 7 against the bias of spring 71. However, once head 40 enters cutout 74, spring 71 will bias it to the position of FIG. 7 whereupon the locking structure 10 is in a locked condition.

While a preferred embodiment of the present invention has been disclosed, it will be appreciated that it is not limited thereto but may be otherwise embodied within the scope of the following claims.

What is claimed is:

1. A lock structure for mounting between first and second supporting surfaces comprising a member, means for mounting said member on said first supporting surface, a housing, means for mounting said housing on said member, a rocker arm, means pivotally mounting said rocker arm on said member, a keeper, means for mounting said keeper on said second supporting surface, means on said rocker arm for effecting a locking engagement with said keeper, spring means for biasing said rocker arm to a locking position relative to said keeper, and key receiving means extending into said rocker arm and keyed thereto for receiving a key for selectively pivoting said rocker arm out of said locking engagement with said keeper.

2. A lock structure as set forth in claim 1 wherein said means for pivotally mounting said rocker arm on said member comprises an internal portion of said rocker arm for mounting on a first external portion of said member, and wherein said means for mounting said housing on said member comprises an internal portion of said housing for mounting on a second external portion of said member.

3. A lock structure as set forth in claim 1 including an inclined head on said keeper, and a camming surface on said rocker arm for engagement with said inclined head to cam said rocker arm against the bias of said spring means when said rocker arm moves over said inclined head.

4. A lock structure as set forth in claim 3 wherein said means for pivotally mounting said rocker arm on said member comprises an internal portion of said rocker arm for mounting on a first external portion of said member, and wherein said means for mounting said housing on said member comprises an internal portion of said housing for mounting on a second external portion of said member.

5. A lock structure as set forth in claim 1 wherein said key-receiving means includes a key-receiving portion, and wherein said member comprises a cup, and wherein said key-receiving configuration is located within said cup.

6. A lock structure as set forth in claim 5 wherein said means for pivotally mounting said rocker arm on said cup comprises an internal portion of said rocker arm for mounting on a first external portion of said cup, and wherein said means for mounting said housing on said cup comprises an internal portion of said housing for mounting on a second external portion of said cup.

7. A lock structure as set forth in claim 1 wherein said member is a cup.

8. A lock structure for mounting between first and second supporting surfaces comprising a member, means for mounting said member on said first supporting surface, a housing, means for mounting said housing on said members, a rocker arm, means pivotally mounting said rocker arm on said member, a keeper, means for mounting said keeper on said second supporting surface, means on said rocker arm for effecting a locking engagement with said keeper, spring means for biasing said rocker arm to a locking position relative to said keeper, key-receiving means mounted on said rocker arm for receiving a key for selectively pivoting said rocker arm out of said locking engagement with said keeper, said means for pivotally mounting said rocker arm on said member comprising an internal portion of said rocker arm for mounting on a first external portion of said member, said means for mounting said housing on said member comprising an internal portion of said housing for mounting on a second external portion of said member, and means on said housing for pivotally mounting said key-receiving means.

9. A lock structure for mounting between first and second supporting surfaces comprising a member, means for mounting said member on said first supporting surface, a housing, means for mounting said housing on said member, a rocker arm, means pivotally mounting said rocker arm on said member, a keeper, means for mounting said keeper on said second supporting surface, means on said rocker arm for effecting a locking engagement with said keeper, spring means for biasing said rocker arm to a locking position relative to said keeper, key-receiving means mounted on said rocker arm for receiving a key for selectively pivoting said rocker arm out of said locking engagement with said keeper, said means for pivotally mounting said rocker arm on said member comprising an internal portion of said rocker arm for mounting on a first external portion of said member, said means for mounting said housing on said member comprising an internal portion of said housing for mounting on a second external portion of said member, and pin means mounted on said first supporting surface for entering said housing and preventing said housing from rotating on said member.

10. A lock structure for mounting between first and second supporting surfaces comprising a member, means for mounting said member on said first supporting surface, a housing, means for mounting said housing on said member, a rocker arm, means pivotally mounting said rocker arm on said member, a keeper, means for mounting said keeper on said second supporting surface, means on said rocker arm for effecting a locking engagement with said keeper, spring means for biasing said rocker arm to a locking position relative to said keeper, key-receiving means mounted on said rocker arm for receiving a key for selectively pivoting said rocker arm out of said locking engagement with said keeper, said means for pivotally mounting said rocker arm on said member comprising an internal portion of said rocker arm for mounting on a first external portion of said member, said means for mounting said housing on said member comprising an internal portion of said housing for mounting on a second external portion of said member, spaced internal wall surfaces in said housing, and spaced external wall surfaces on said rocker arm located within said spaced internal wall surfaces for sliding movement relative thereto.

11. A lock structure as set forth in claim 10 including an inclined head on said keeper, and a camming surface on said rocker arm for engagement with said inclined head to cam said rocker arm against the bias of said spring means when said rocker arm moves over said inclined head.

12. A lock structure as set forth in claim 11 wherein said key-receiving means comprises an actuator bolt, means for mounting said actuator bolt in keyed relationship on said rocker arm, and a key-receiving configuration on said actuator bolt.

13. A lock structure as set forth in claim 7 wherein said key-receiving means includes a key-receiving portion, and wherein said member comprises a cup, and wherein said key-receiving configuration is located within said cup.

14. A lock structure for mounting between first and second supporting surfaces comprising a member, means for mounting said member on said first supporting surface, a housing, means for mounting said housing on said member, a rocker arm, means pivotally mounting said rocker arm on said member, a keeper, means for mounting said keeper on said second supporting surface, means on said rocker arm for effecting a locking engagement with said keeper, spring means for biasing said rocker arm to a locking position relative to said keeper, key-receiving means mounted on said rocker arm for receiving a key for selectively pivoting said rocker arm out of said locking engagement with said keeper, an inclined head on said keeper, a camming surface on said rocker arm for engagement with said inclined head to cam said rocker arm against the bias of said spring means when said rocker arm moves over said inclined head, said means for pivotally mounting said rocker arm on said member comprising an internal portion of said rocker arm for mounting on a first external portion of said member, said means for mounting said housing on said member comprising an internal portion of said housing for mounting on a second external portion of said member, said key-receiving means comprising an actuator bolt, means for mounting said actuator bolt in keyed relationship on said rocker arm, and a key-receiving configuration on said actuator bolt.

15. A lock structure as set forth in claim 14 wherein said key-receiving means includes a key-receiving portion, and wherein said member comprises a cup, and wherein said key-receiving configuration is located within said cup.

16. A lock structure as set forth in claim 15 including means on said housing for pivotally mounting said key-receiving means.

17. A lock structure for mounting on a surface comprising a member for mounting on said surface, a housing mounted on said member, a rocker arm located on said housing and pivotally mounted on said member, an actuator bolt extending into and keyed to said rocker arm and rotatably mounted in said housing, and a key-receiving pattern on said actuator bolt for receiving a mating key for pivoting said actuator bolt and said rocker arm keyed thereto.

18. A lock structure as set forth in claim 17 wherein said member is a cup, and wherein said key-receiving pattern of said actuator bolt is located in said cup.

19. A lock structure as set forth in claim 17 including spring means between said housing and said rocker arm for biasing said rocker arm to a locking position.

20. A lock structure as set forth in claim 19 wherein said member is a cup, and wherein said key-receiving pattern of said actuator bolt is located in said cup.

21. A lock structure as set forth in claim 17 wherein said member is a cup.

22. A lock structure for mounting on a surface comprising a member for mounting on said surface, a housing mounted on said member, a rocker arm located on said housing and pivotally mounted on said member, an actuator bolt keyed to said rocker arm and rotatably mounted in said housing, a key-receiving pattern on said actuator bolt for receiving a mating key for pivoting said actuator bolt and said rocker arm keyed thereto, and means for removably mounting said actuator bolt on said housing and said rocker arm so as to permit replacement thereof with an actuator bolt having a different key-receiving pattern thereon.

23. A lock structure for mounting on a surface comprising a member for mounting on said surface, a housing mounted on said member, a rocker arm located on said housing and pivotally mounted on said member, an actuator bolt keyed to said rocker arm and rotatably mounted in said housing, a key-receiving pattern on said actuator bolt for receiving a mating key for pivoting said actuator bolt and said rocker arm keyed thereto, said member being a cup, said key-receiving pattern of said actuator bolt being located in said cup, and means for removably mounting said actuator bolt on said housing and said rocker arm so as to permit replacement thereof with an actuator bolt having a different key-receiving pattern thereon.

24. A lock structure for mounting on a surface comprising a member for mounting on said surface, a housing mounted on said member, a rocker arm located on said housing and pivotally mounted on said member, an actuator bolt keyed to said rocker arm and rotatably mounted in said housing, a key-receiving pattern on said actuator bolt for receiving a mating key for pivoting said actuator bolt and said rocker arm keyed thereto, spring means between said housing and said rocker arm for biasing said rocker arm to a locking position, said member being a cup, said key-receiving pattern of said actuator bolt being located in said cup, and means for removably mounting said actuator bolt on said housing and said rocker arm so as to permit replacement thereof with an actuator bolt having a different key-receiving pattern thereon.

25. A lock structure for mounting on a supporting surface comprising a housing, a member mounting said housing on said supporting surface, a cylindrical surface on said member, a rocker arm, means pivotally mounting said rocker arm on said cylindrical surface, and actuator bolt, means mounting said actuator bolt relative to said member, means coupling said actuator bolt to said rocker arm to effect pivotal movement thereof, and a patterned head on said actuator bolt for receiving a mating patterned key.

26. A lock structure as set forth in claim 25 including spring means between said housing and said rocker arm for biasing said rocker arm to a locking position.

27. A lock structure as set forth in claim 26 including keeper means, means for mounting said keeper means on a second supporting surface, and means on said keeper means for coacting with said rocker arm to effect locking engagement therebetween under bias of said spring means.

* * * * *

UNITED STATES PATENT AND TRADEMARK OFFICE

CERTIFICATE OF CORRECTION

PATENT NO. : 5,345,795

DATED : September 13, 1994

INVENTOR(S) : Brent A. James et al

It is certified that error appears in the above-indentified patent and that said Letters Patent is hereby corrected as shown below:

Column 5, line 12 (claim 8), change "members" to --member--.

Column 6, line 17 (claim 13), change "7" to --12--.

Column 8, line 21 (claim 25), change "and" to --an--.

Signed and Sealed this

Eighth Day of November, 1994

*Attest:*

*Attesting Officer*

Bruce Lehman

BRUCE LEHMAN

*Commissioner of Patents and Trademarks*